US008155369B2

(12) United States Patent
Wu

(10) Patent No.: US 8,155,369 B2
(45) Date of Patent: Apr. 10, 2012

(54) EAR HOOK MICROPHONE

(76) Inventor: Ying Jui Wu, Taipei (TW)

( * ) Notice: Subject to any disclaimer, the term of this patent is extended or adjusted under 35 U.S.C. 154(b) by 891 days.

(21) Appl. No.: 12/193,701

(22) Filed: Aug. 18, 2008

(65) Prior Publication Data

US 2009/0296974 A1 Dec. 3, 2009

(30) Foreign Application Priority Data

May 30, 2008 (CN) ..... 2008 2 0094336 U

(51) Int. Cl.
*H04R 25/00* (2006.01)

(52) U.S. Cl. ..... 381/381

(58) Field of Classification Search ..... 381/370–371, 381/380–381, 374, 376, 382, 384, 379
See application file for complete search history.

(56) References Cited

U.S. PATENT DOCUMENTS 7,110,535 B2 * 9/2006 Bodley et al. ..... 379/430

* cited by examiner

*Primary Examiner* — Hoa B Trinh

(57) ABSTRACT

An ear hook microphone comprises an ear hook, a cable pole, a cable pole receiving device and a cable pole adjusting device. The ear hook comprises an injection position. The cable pole receiving device is fixed in the injection position and comprises an underlying flange. The cable pole adjusting device is fixed in the cable pole receiving device, which includes a fixed block, a pressing block, a button and a plurality of flexible members. The fixed block includes a base plate. A button hole is formed in the middle of the base plate. Two side plates upwardly extend from the two opposite ends of the base plate respectively. Each of the two side plates opens a through hole at the cable pole. The pressing block is placed between the two side plates. The top end of the button inserts through the button hole then connects with the pressing block. The button comprises a bar. The top end of the bar has a perforated hole. An upborne flange protrudes from the lower portion of the bar. The upborne flange shall be placed on the underlying flange. The plurality of flexible members are fixed to press the cable pole tightly. The cable pole is inserted into the two through holes and the perforated hole.

5 Claims, 2 Drawing Sheets

EAR HOOK MICROPHONE

BACKGROUND OF THE INVENTION

The present invention relates to a kind of microphone.

With progress of technology and improvements of people's living conditions, various high-tech products are widely used more and more. For example, all kinds of microphones are used in a meeting room or other business occasions. We have designed a lot of different microphones including ear hook microphones.

For the ear hook microphone presently, an ear hook microphone usually includes an ear hook which is worn on a user's ear, a cable pole which extends forwardly from the ear hook and a microphone which is connected at the distal end of the cable pole. The product is made of common metallic tube, to some extent, it is flexible and is helpful for restoring the original shape after using. The Chinese utility model patent NO.: 200520011973.1 with the title "An Ear Hook Microphone" filed on Apr. 30, 2005. has many progress on the basis of the prior art. The ear hook microphone includes an ear hook which is worn on a user's ear. A cable pole extends from one end of the ear hook. A microphone is fixed at the distal end of the cable pole. A stop block is formed at the other end of the ear hook, which presses on the rear portion of the ear. The ear hook is coiled to be an unenclosed and semicircular structure by a wire. The stop block links a plurality of cables which transmit electric signals. The ear hook is flexible.

However, there are still some defects existed in the technology at present. The existing microphone is usually produced into a whole. The ear hook and the cable pole is integrated into a whole or the cable pole is fixed on the ear hook directly, which restricts the length of the cable pole. So we cannot provide more different positions of the microphone to a user. Even if the user bends the cable pole to adjust the position of the microphone, the cable pole is easy to be worn out or broken after repeated bending.

BRIEF SUMMARY OF THE INVENTION

The object of the present invention is to provide an ear hook microphone, wherein the position of the microphone can be conveniently and easily adjusted, the long distance for adjusting, convenience for using, and the usage period of the product is longer than prior products.

The present invention indicates a technical solution to achieve the object: An ear hook microphone comprises an ear hook, a cable pole, a cable pole receiving device and a cable pole adjusting device. The ear hook comprises an injection position. The cable pole receiving device is fixed in the injection position. The cable pole receiving device comprises a fixed block groove, a pressing block groove, a cable pole groove, a button groove and an underlying flange. The cable pole adjusting device is fixed in the cable pole receiving device, which includes a fixed block, a pressing block, a button and a plurality of flexible members. The fixed block is fixed in the fixed block groove, which includes a base plate. A button hole is formed in the middle of the base plate. Two side plates upwardly extend from the two opposite ends of the base plate respectively. Each of the two side plates opens a through hole that allows the cable pole to pass through. The pressing block is fixed in the pressing block groove and placed between the two side plates. The button is fixed in the button groove. The top end of the button inserts through the button hole then connects with the pressing block. The button comprises a bar. The top end of the bar has a perforated hole where the cable pole can insert. An upborne flange protrudes from the lower portion of the bar. The upborne flange shall be placed on the underlying flange. One flexible member of the plurality of flexible members is sleeved on the bar, which is fixed and pressed between the upborne flange and the bottom wall of the base plate. The other flexible members of the plurality of flexible members are fixed and pressed between the top wall of the pressing block groove and the pressing block. The cable pole is inserted into the two through holes and the perforated hole and fixed in the cable pole groove.

The ear hook microphone in accordance with the present invention has many advantages than prior arts. After fixing the cable pole adjusting device into the cable pole receiving device, the two parts are fixed in the ear hook. The flexible members can force the pressing block and the button to tightly press the cable pole in order to clip the cable pole stably. We only need to pull the cable pole with pressing on the button to adjust the position of the cable pole. Apparently, the ear hook microphone can conveniently adjust the positions of the cable pole and the microphone, and the adjusting distance is very long, and the usage period of the product is extended because of avoiding bending the cable pole frequently

DETAILED DESCRIPTION OF THE INVENTION

Figure 1:
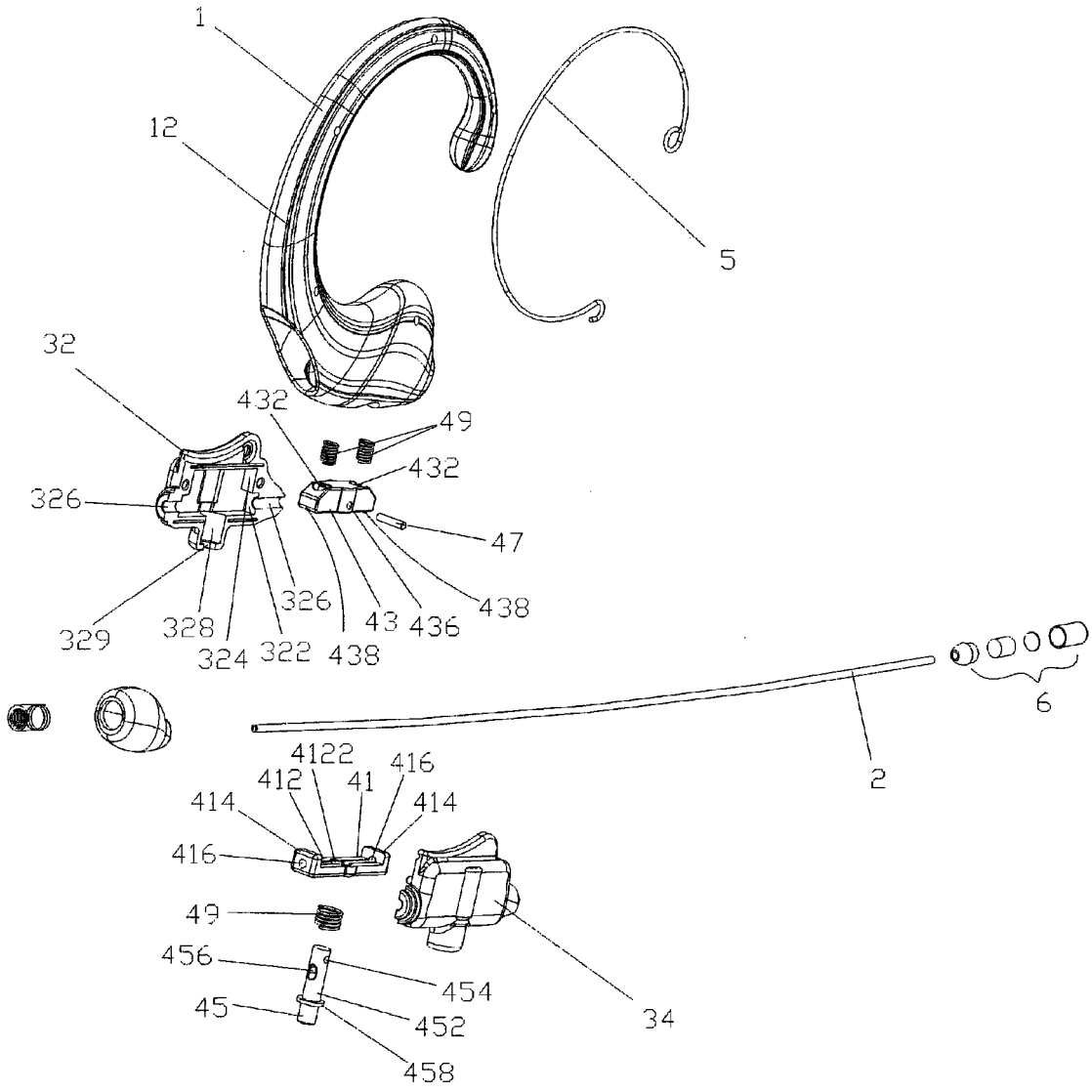
FIG. 1 is an exploded view of the embodiment of the present invention.
Figure 2:
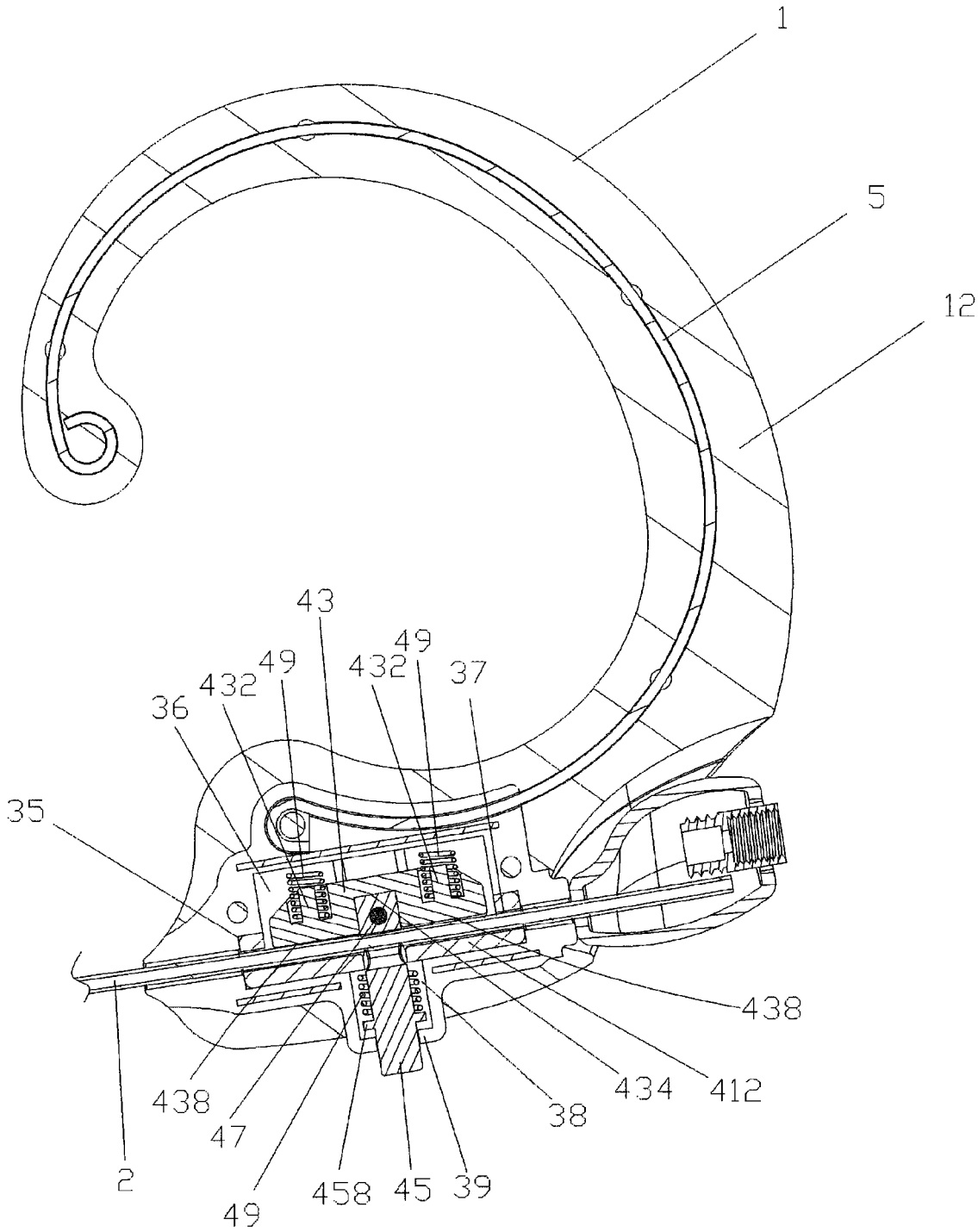
FIG. 2 is a cutaway view of the embodiment of the present invention in assembly.

As shown in FIG. 1 and FIG. 2, an ear hook microphone in accordance with the present invention comprises an ear hook 1, a cable pole 2, a cable pole receiving device (not marked in drawings), a cable pole adjusting device (not marked in drawings), a flexible steel wire 5 and a microphone 6.

The ear hook 1 is injected with an unclosed semi-surrounding structure, which can be worn on the user's ear. The ear hook 1 includes an injection position 12.

The cable pole 2 is made of flexible material, which can be bended. A plurality of cables (not shown in drawings) which be used to transmit electric signals are defined inside of the cable pole 2.

The cable pole receiving device is fixed in the injection position 12 of the ear hook 1. The cable pole receiving device comprises a first receiving component 32 and a second receiving component 34.

The first receiving component 32 and the second receiving component 34 can be put together to become an integrated whole by means of some pillars (not shown in drawings) inserting into some grooves (not shown in drawings), and they also can be divided into two unattached parts.

A first fixed block groove 322 is formed on the first receiving component 32 after cutting. A first pressing block groove 324 is formed by upwardly cutting from the top portion of the first fixed block groove 322. The first pressing block groove 324 is through to the first fixed block groove 322. Two first cable pole grooves 326 are respectively formed by cutting at the left side and the right side of the first fixed block groove 322. A first button groove 328 is formed by downwardly cutting from the middle of the lower portion of the first fixed block groove 322. A first semiannular flange 329 inwardly extends from the bottom of the first button groove 328 in the radial direction.

A second fixed block groove (not shown in drawings) is formed on the second receiving component 34 after cutting. A second pressing block groove (not shown in drawings) is formed through to the second fixed block groove by upwardly cutting from the top portion of the second fixed block groove. Two second cable pole grooves (not shown in drawings) are respectively formed by cutting at the left side and the right side of the second fixed block groove. A second button groove (not shown in drawings) is formed by downwardly cutting from the middle of the lower portion of the second fixed block groove. A second semiannular flange inwardly extends from the bottom of the second button groove in the radial direction.

After the first receiving component 32 and the second receiving component 34 are put together to become an integrated whole, a fixed block groove 35 is formed by the combination of the first fixed block groove 322 and the second fixed block groove, and a pressing block groove 36 is formed by the combination of the first pressing block groove 324 and the second pressing block groove, and a cable pole groove 37 is formed by the combination of the first cable pole groove 326 and the second cable pole groove, and a button groove 38 is formed by the combination of the first button groove 328 and the second button groove, and an underlying flange 39 is formed by the combination of the first semiannular flange 329 and the second semiannular flange.

The cable pole adjusting device is fixed in the cable pole receiving device, which includes a fixed block 41, a pressing block 43, a button 45, an inserting pin 47 and three springs 49.

The fixed block 41 is fixed in the fixed block groove 35, which includes a base plate 412. A button hole 4122 is formed in the middle of the base plate 412. Two side plates 414 upwardly extend from the two opposite ends of the base plate 412 respectively. Each of the two side plates 414 opens a through hole 416 the cable pole 2 can pass through.

The pressing block 43 is fixed in the pressing block groove 36. The pressing block 43 is placed between the two side plates 414. Two protruding pillars 432 respectively protrude upwardly from the two ends of the top portion of the pressing block 43. A groove 434 is formed by inwardly digging from the bottom of the pressing block 43. Two opposite inserting holes 436 are formed by respectively cutting in the wall of the pressing block 43 around the groove 434. Two added blocks 438 made of flexible material is fixed on the bottom wall of the pressing block 43.

The button 45 is fixed in the button groove 38. The top end of the button 45 inserts through the button hole 4122 and the groove 434, then connects the pressing block 43 in the groove 434. The button 45 comprises a bar 452. The top end of the bar 452 has a through hole 454 corresponding to the two inserting holes 436 and a perforated hole 456 where the cable pole 2 can insert. An upborne flange 458 protrudes from the lower portion of the bar 452. In assembly, the upborne flange 458 shall be placed on the underlying flange 39.

The inserting pin 47 is inserted into the two inserting holes 436 and the through hole 454, then the button 45 is connected with the fixed block 41.

Two springs 49 out of three springs 49 are respectively sleeved on the two protruding pillars 432, which both are fixed and pressed between the top wall of the pressing block groove 36 and the pressing block 43. The resilience of the two springs 49 pushes the pressing block 43 downwardly. The another spring 49 of the three springs 49 is sleeved on the bar 452, which is fixed and pressed between the upborne flange 458 and the bottom wall of the base plate 412. The resilence of the other spring 49 pulls the button 45 downwardly.

While assembling the ear-hanging microphone in accordance with the invention, first we shall sleeve a spring 49 on the bar 452, and let the top end of the bar 452 head through the button hole 4122, and press the pressing block 43 to the fixed block 41, then insert the top end of the bar 452 into the groove 434, then insert the inserting pin 47 through the two inserting holes 436 and the through hole 454, at this time, the pressing block 43, the button 45 and the fixed block 41 are connected together. Then, we shall insert the cable pole 2 into the two through holes 416 and the perforated hole 456, and respectively sleeve the other two springs 49 on the two protruding pillars 432, then place them as a whole into the first receiving component 32. After that, combine the second receiving component 34 with the first receiving component 32. At this time, the fixed block 41 is fixed in the fixed block groove 35, and the pressing block 43 is fixed in the pressing block groove 36, and the cable pole 2 is fixed in the cable pole groove 37, and the button 45 is fixed in the button groove 38, and the upborne flange 458 is placed on the underlying flange 39.

When the button 45 is not pressed, the two springs 49 push the pressing block 43 and the another spring 49 pulls the button 45 to force the pressing block 43 and the button 45 to tightly press the cable pole 2 on the fixed block 41. The two added blocks 438 can increase the pressing force to the cable pole 2, then the cable pole 2 can be fixed so tightly that it can't be dragged to move.

When we want to adjust the position of the cable pole 2 or the microphone 6, we shall just use a finger to press the button 45 to force the bar 452 to move upwardly. The top end of the bar 452 upwardly supports the pressing block 43 to reduce the pressing force that the pressing block 43 and the bar 452 bring pressure to the cable pole 2, so it is convenient and easy to pull the cable pole 2 to adjust its position. After adjusting well, we shall just move away the finger to release the button 45, and the cable pole is tightly pressed again like before.

The flexible steel wire 5 is bent to a similar shape like the ear hook 1. The flexible steel wire 5 is hermetically fixed in the injection position 12.

The microphone 6 is fixed at the distal end of the cable pole 2.

The ear hook microphone in accordance with the present invention has many advantages than prior arts. After fixing the cable pole adjusting device into the cable pole receiving device, the two parts are fixed in the ear hook 1. The three springs 49 can force the pressing block 43 and the button 45 to tightly press the cable pole 2 in order to clip the cable pole 2 stably. When we need to adjust the position of the cable pole 2, we shall just press the button 45, then pull the cable pole 2. Apparently, the ear hook microphone can conveniently adjust the positions of the cable pole 2 and the microphone 6, and the adjusting distance is very long, so the usage period of the product is extended because of avoiding bending the cable pole 2 frequently. Ear hook adopts flexible material to make users to wear it comfortably, it also contains flexible wire 5 strengthen its flexibility and strength to insure durability.

I claim:

1. An ear hook microphone comprising:

an ear hook, which comprising an injection position;

a cable pole;

a cable pole receiving device, which being fixed in said injection position, which comprising a fixed block groove, a pressing block groove, a cable pole groove, a button groove and an underlying flange; and a cable pole adjusting device, which being fixed in said cable pole receiving device, which including a fixed block, a pressing block, a button and a plurality of flexible members, the fixed block being fixed in said fixed block groove, which including a base plate, and a button hole being formed in the middle of the base plate, and two side plates upwardly extending from the two opposite ends of the base plate respectively, and each of the two side plates opening a through hole that allows the cable pole being able to pass through, the pressing block being fixed in said pressing block groove and placed between said two side plates;

the button being fixed in said button groove, and the top end of the button inserting through said button hole then connecting with the pressing block, and the button comprising a bar, the top end of the bar having a perforated hole where the cable pole being able to insert, and an upborne flange protruding from the lower portion of the bar, and the upborne flange being placed on the underlying flange, one flexible member of the plurality of flexible members being sleeved on the bar, which being fixed and pressed between the upborne flange and the bottom wall of the base plate, and the other flexible members of the plurality of flexible members being fixed and pressed between the top wall of the pressing block groove and the pressing block;

the cable pole being inserted into said two through holes and said perforated hole and fixed in the cable pole groove;

said cable pole adjusting device further includes an inserting pin, and a groove is formed by inwardly digging from the bottom of the pressing block, and two opposite inserting holes are formed by respectively cutting in the wall of the pressing block around the groove, and the top end of the bar has a through hole corresponding to the two inserting holes, then the inserting pin is inserted through the two inserting holes and the through hole to force the button to connect the pressing block;

said cable pole adjusting device includes three flexible members, the flexible members are springs, and two protruding pillars respectively protrude upwardly from the two ends of the top portion of the pressing block, and two springs of the three springs are respectively sleeved on the two protruding pillars, and the another spring the three springs is sleeved on the bar.

2. An ear hook microphone according to claim 1, wherein said ear hook microphone further comprises a flexible steel wire, which is hermetically fixed in the injection position.

3. An ear hook microphone according to claim 1, wherein said cable pole receiving device comprises a first receiving component and a second receiving component; a first fixed block groove is formed on the first receiving component and a first pressing block groove is formed by upwardly cutting from the top portion of the first fixed block groove, and the first pressing block groove is through to the first fixed block groove, and two first cable pole grooves are respectively formed by cutting at the left side and the right side of the first fixed block groove, and a first button groove is formed by downwardly cutting from the middle of the lower portion of the first fixed block groove, and a first semiannular flange inwardly extends from the bottom of the first button groove in the radial direction; a second fixed block groove is formed on the second receiving component after cutting, and a second pressing block groove is formed by upwardly cutting from the top portion of the second fixed block groove, and the second pressing block groove is through to the second fixed block groove, and two second cable pole grooves are respectively formed by cutting at the left side and the right side of the second fixed block groove, and a second button groove is formed by downwardly cutting from the middle of the lower portion of the second fixed block groove, and a second semiannular flange inwardly extends from the bottom of the second button groove in the radial direction; the first receiving component and the second receiving component are put together to become the cable pole receiving device, and the fixed block groove is formed by the combination of the first fixed block groove and the second fixed block groove, and the pressing block groove is formed by the combination of the first pressing block groove and the second pressing block groove, and the cable pole groove is formed by the combination of the first cable pole groove and the second cable pole groove, and the button groove is formed by the combination of the first button groove and the second button groove, and the supporting flange is formed by the combination of the first semiannular flange and the second semiannular flange.

4. An ear hook microphone according to claim 1, wherein said flexible members are springs.

5. An ear hook microphone according to claim 1, wherein two added blocks made of flexible material are fixed on the bottom wall of the pressing block.

* * * * *